US005400106A

United States Patent [19]

Rosenburgh et al.

[11] Patent Number: 5,400,106

[45] Date of Patent: Mar. 21, 1995

[54] AUTOMATIC TRAY PROCESSOR

[75] Inventors: John H. Rosenburgh, Hilton; Joseph A. Manico, Rochester; David L. Patton, Webster; Ralph L. Piccinino, Jr., Rush, all of N.Y.

[73] Assignee: Eastman Kodak Company, Rochester, N.Y.

[21] Appl. No.: 209,582

[22] Filed: Mar. 10, 1994

Related U.S. Application Data

[63] Continuation-in-part of Ser. No. 57,250, May 3, 1993.

[51] Int. Cl.[6] ..... G03D 3/02

[52] U.S. Cl. ..... 354/324

[58] Field of Search ..... 354/319–324; 134/64 P, 64 R, 122 P, 122 R

[56] References Cited

U.S. PATENT DOCUMENTS

| | | | |
|---|---|---|---|
| 1,451,065 | 4/1923 | Dye . | |
| 2,158,817 | 5/1939 | Doetzel | 95/94 |
| 2,404,138 | 7/1946 | Mayer | 95/94 |
| 2,602,387 | 7/1952 | Pohl | 95/94 |
| 2,981,170 | 5/1961 | Brault | 95/89 |
| 3,081,687 | 3/1963 | Takats | 95/89 |
| 3,372,630 | 3/1968 | Schmidt | 95/94 |
| 3,448,720 | 6/1969 | Graham | 118/109 |
| 3,643,628 | 2/1972 | Sugarman et al. | 118/637 |
| 3,752,054 | 8/1973 | Scanlan | 95/94 |
| 3,846,816 | 11/1974 | Gaisser | 354/307 |
| 3,903,541 | 9/1975 | Von Meister et al. | 354/317 |
| 4,123,769 | 10/1978 | Fernandez et al. | 354/322 |
| 4,140,384 | 2/1979 | Shintani et al. | 354/321 |
| 4,142,194 | 2/1979 | Hamlin | 354/318 |
| 4,327,987 | 5/1982 | Friar et al. | 354/317 |
| 4,327,988 | 5/1982 | Vanhorebeek et al. | 354/320 |
| 4,359,279 | 11/1982 | Popoff | 354/320 |
| 4,466,722 | 8/1984 | Staude | 354/299 |
| 4,577,949 | 3/1986 | Geyken et al. | 354/319 |
| 4,708,452 | 11/1987 | Schoen | 354/317 |
| 4,709,716 | 12/1987 | Raush et al. | 134/122 |
| 4,853,727 | 8/1989 | Ganzke et al. | 354/319 |
| 4,875,067 | 10/1989 | Kanzaki et al. | 354/325 |
| 4,922,276 | 5/1990 | Lamprecht et al. | 354/322 X |
| 4,974,541 | 12/1990 | Miyabayashi | 118/659 |
| 4,987,438 | 1/1991 | Goto et al. | 354/319 |
| 4,989,028 | 1/1991 | Hall et al. | 354/324 |
| 4,994,840 | 1/1991 | Hall et al. | 354/324 |
| 5,034,767 | 7/1991 | Netz et al. | 354/317 |
| 5,047,795 | 9/1991 | Keable et al. | 354/320 |
| 5,079,580 | 1/1992 | Wada | 354/299 |
| 5,179,404 | 1/1993 | Bartell | 354/320 |
| 5,182,593 | 1/1993 | Fischer | 354/322 |

FOREIGN PATENT DOCUMENTS

| | | |
|---|---|---|
| 0352720A2 | 7/1989 | European Pat. Off. . |
| WO91/12567 | 8/1991 | WIPO . |

*Primary Examiner*—D. Rutledge
*Attorney, Agent, or Firm*—Frank Pincelli

[57] ABSTRACT

A low volume photographic material processing apparatus that utilizes a narrow horizontal processing channel. The channel is formed by a repeating combination of squeegee pinch rollers and impingement slot nozzles. Photographic processing solution is introduced through the impingement slot nozzles and the squeegee pinch rollers are used to remove the processing solution from the photosensitive material and provide transport of the photosensitive material. Solution level control is achieved by drains positioned below the tops of the upturned sections.

23 Claims, 7 Drawing Sheets

AUTOMATIC TRAY PROCESSOR

CROSS REFERENCE TO RELATED APPLICATIONS

This is a continuation-in-part of application Ser. No. 08/057,250, filed May 3, 1993.

Reference is also made to commonly assigned co-pending patent applications:

Ser. No. 08/056,458, filed May 3, 1993, entitled "MODULAR PROCESSING CHANNEL FOR AN AUTOMATIC TRAY PROCESSOR" in the names of Joseph A. Manico, Ralph L. Piccinino, Jr., David L. Patton and John H. Rosenburgh and continuation in part of Ser. No. 08/056,458, filed concurrently herewith having Ser. No. 08,209,756;

Ser. No. 08/056,477, filed May 3, 1993, entitled "COUNTER CROSS FLOW FOR AN AUTOMATIC TRAY PROCESSOR" in the names of John H. Rosenburgh, Ralph L. Piccinino, Jr., David L. Patton and Joseph A. Manico and continuation in part of Ser. No. 08/056,447, filed concurrently herewith having Ser. No. 08/209,180;

Ser. No. 08/057,131, filed May 3, 1993, entitled "VERTICAL AND HORIZONTAL POSITIONING AND COUPLING 0F AUTOMATIC TRAY PROCESSOR CELLS" in the names of David L. Patton, Joseph A. Manico, John H. Rosenburgh and Ralph L. Piccinino, Jr. and continuation in part of Ser. No. 08/057,131, filed concurrently herewith having Ser. No. 08/209,754;

Ser. No. 08/056,451, filed May 3, 1993, entitled "TEXTURED SURFACE WITH CANTED CHANNELS FOR AN AUTOMATIC TRAY PROCESSOR" in the names of Ralph L. Piccinino, Jr., John H. Rosenburgh, David L. Patton and Joseph A. Manico and continuation in part of Ser. No. 08/056,451, filed concurrently herewith having Serial No. 08/209,093;

Ser. No. 08/056,730, filed May 3, 1993, entitled "AUTOMATIC REPLENISHMENT, CALIBRATION AND METERING SYSTEM FOR AN AUTOMATIC TRAY PROCESSOR" in the names of John H. Rosenburgh, Robert L. Horton and David L. Patton and continuation in part of Ser. No. 08/056,730, filed concurrently herewith having Ser. No. 08/209,758;

Ser. No. 08/056,457, filed May 3, 1993, entitled "CLOSED SOLUTION RECIRCULATION/SHUT-OFF SYSTEM FOR AN AUTOMATIC TRAY PROCESSOR" in the names of John H. Rosenburgh, Joseph A. Manico, Ralph L. Piccinino, Jr. and David L. Patton and continuation in part of Ser. No. 08/056,457, filed concurrently herewith having Ser. No. 08/209,179;

Ser. No. 08/056,649, filed May 3, 1993, entitled "A SLOT IMPINGEMENT FOR AN AUTOMATIC TRAY PROCESSOR" in the names of John H. Rosenburgh, David L. Patton, Joseph A. Manico and Ralph L. Piccinino, Jr. and continuation in part of Ser. No. 08/056,649, filed concurrently herewith having Ser. No 08/209,755; and Ser. No. 08/056,455, filed May 3, 1993, entitled "AUTOMATIC REPLENISHMENT, CALIBRATION AND METERING SYSTEM FOR A PHOTOGRAPHIC PROCESSING APPARATUS" in the names of John H. Rosenburgh, Robert L. Horton and David L. Patton.

The above applications are all incorporated by reference herein in their entirety.

FIELD OF THE INVENTION

The invention relates to the field of photography, and particularly to a photosensitive material processing apparatus.

BACKGROUND OF THE INVENTION

The processing of photosensitive material involves a series of steps such as developing, bleaching, fixing, washing, and drying. These steps lend themselves to mechanization by conveying a continuous web of film or cut sheets of film or photographic paper sequentially through a series of stations or tanks, each one containing a different processing liquid appropriate to the process step at that station.

There are various sizes of photographic film processing apparatus, i.e., large photofinishing apparatus and microlabs. A large photofinishing apparatus utilizes tanks that contain approximately 100 liters of each processing solution. A small photofinishing apparatus or microlab utilizes tanks that may contain less than 10 liters of processing solution.

The chemicals contained in the processing solution: cost money to purchase; change in activity and are seasoned by the constituents of the photosensitive materials that leach out during the photographic process; and after the chemicals are used the chemicals must be disposed of in an environmentally safe manner. Thus, it is important in all sizes of photofinishing apparatus to reduce the volume of processing solution. The prior art suggest various types of replenishing systems that add or subtract specific chemicals to the processing solution to maintain a consistency of photographic characteristics in the material developed. It is possible to maintain reasonable consistency of photographic characteristics only for a certain period of replenishment. After a processing solution has been used a given number of times, the solution is discarded and a new processing solution is added to the tank.

Activity degradation due to instability of the chemistry, or chemical contamination, after the components of the processing solution are mixed together causes one to discard the processing solution in smaller volume tanks more frequently than larger volume tanks. Some of the steps in the photographic process utilizes processing solutions that contain chemicals that are unstable, i.e., they have a short process life. Thus, processing solutions in tanks that contain unstable chemicals are discarded more frequently than processing solutions in tanks that contain stable chemicals.

Problems to Be Solved by the Invention

The prior art used automatic photoprocessing equipment to process photosensitive material. Automatic photoprocessing equipment typically is configured as a sequential arrangement of transport racks submerged in tanks filled with volumes of processing solutions. The shape and configuration of the racks and tanks are inappropriate in certain environments, for instance: offices, homes, computer areas, etc.

The reason for the above is the potential damage to the equipment and the surroundings that may occur from spilled photographic processing solutions and the lack of facilities, i.e., running water and sinks to clean the racks and flush out the tanks. Photographic materials may become jammed in the processing equipment.

In this situation the rack must be removed from the tank to gain access to the jammed photographic material in order to remove the jammed material. The shape and configuration of the racks and tanks made it difficult to remove a rack from a tank without spilling any processing solution.

The configuration of the rack and the tank is primarily due to the need to constantly provide active processing solution to the photosensitive material. One of the primary functions of a rack and tank processor is to provide the proper agitation of the processing solution. Proper agitation will send fresh processing solution to the surface or surfaces of the photosensitive material, while removing the exhausted processing solution from the photosensitive material.

The prior art also used alternative techniques to remove exhausted processing solution from the surface or surfaces of the photosensitive material and to provide fresh processing solution to the surface or surfaces of the photosensitive material. These techniques include rotating pattern drums, mesh screens, solution jets and squeegee blades, etc. Mesh screens and rotating drums work well in removing exhausted processing solution and supplying fresh processing solution. Mesh screens, squeegee blades and drums may damage the delicate surface or surfaces of the photosensitive material. The damage may be caused by debris that accumulates within the mesh, on the blade, or on the drum surface. Solution jets provide a method for removing and supplying fresh processing solution to and from the surface or surfaces of the photosensitive material. However, solution jets may cause non-uniform processing of the photosensitive material.

The problem of non-uniform processing of the photosensitive materials is exacerbated when the solution jets are used in close proximity to the photosensitive material. An additional problem with the rotating drum is that the rotating drum is large and thus limits the minimum size of the processing equipment. A further problem with a rotating drum is that it can only process one sheet of photosensitive material at a time.

The prior art suggest that if the volume of the various tanks contained within various sizes of photographic processing apparatus were reduced the same amount of film or photographic paper may be processed, while reducing the volume of processing solution that was used and subsequently discarded. One of the problems in using smaller volume tanks is to provide sufficient agitation of the photosensitive material. Another problem in using low volume tanks is that the material being processed typically has a tendency to jam. An additional problem was that it was difficult and time-consuming to separate the rack from the tank for cleaning and maintenance purposes. A further problem was that processors are typically configured to handle photosensitive material in a roll format or a cut sheet format.

A further problem with existing processors is that the processor may only process, at a given time, photosensitive material in a roll or cut sheet format. In addition, processors that are configured to process photosensitive material in a cut sheet format, may be limited in their ability to process the photosensitive material, by the minimum or maximum length of the photosensitive material, that may be transported.

Additional rollers are required to transport shorter photosensitive material lengths. The reason for this is that, a portion of the photosensitive material must always be in physical contact with a pair of transporting rollers, or the cut sheet of photosensitive material will fail to move through the entire processor. As the number of required transport rollers increases, the agitation of the processing solution decreases. Even though the rollers remove processing solution and hence, break up the boundary layer, the additional rollers severely impede the flow of fresh processing solution to and exhausted processing solution from the surface of the photosensitive material.

SUMMARY OF THE INVENTION

This invention overcomes the disadvantages of the prior art by providing a low volume photographic material processing apparatus that utilizes a narrow horizontal processing channel with an upturned entrance and exit to contain the processing solution within the channel. The channel is formed by a repeating combination of squeegee pinch rollers and impingement slot nozzles. Photographic processing solution is introduced through the impingement slot nozzles and the squeegee pinch rollers are used to remove the processing solution from the photosensitive material and provide transport of the photosensitive material. Solution level control is achieved by drains positioned below the tops of the upturned sections.

Advantageous Effect of the Invention

The above arrangement of squeegee pinch rollers and solution impingement slot nozzles, provide transport of either cut sheet or roll photosensitive material and work interactively to provide fresh processing solution to the photosensitive material while removing exhausted processing solution from the photosensitive material.

The processing apparatus will contain a smaller volume of the same photographic solution that was previously used in regular-sized processing tanks. In fact, in some instances, the volume of photographic solution utilized in regular-sized tanks may be reduced by as much as 90%. Hence, the apparatus of this invention is capable of reducing the volume of photographic solution that is used and subsequently discarded by photographic processing apparatus while permitting easy access to the processing apparatus for maintenance purposes.

The foregoing is accomplished by providing an apparatus for processing photosensitive materials, which comprises:

a processing module comprising a container and at least one processing assembly placed in the container, the at least one processing assembly forming a processing channel through which a processing solution flows, the processing channel comprising at least 40% of the total volume of processing solution available for the processing module and having a thickness equal to or less than about 100 times the thickness of the photosensitive material to be processed in the processing channel;

transport means for transporting the photosensitive material from the channel entrance through the channel to the channel exit; and means for circulating the processing solution through the small volume provided in the processing channel, the processing channel and means for recirculating the processing solution being dimension so that a small volume for holding processing solution is provided.

DESCRIPTION OF THE PREFERRED EMBODIMENT

Figure 1:
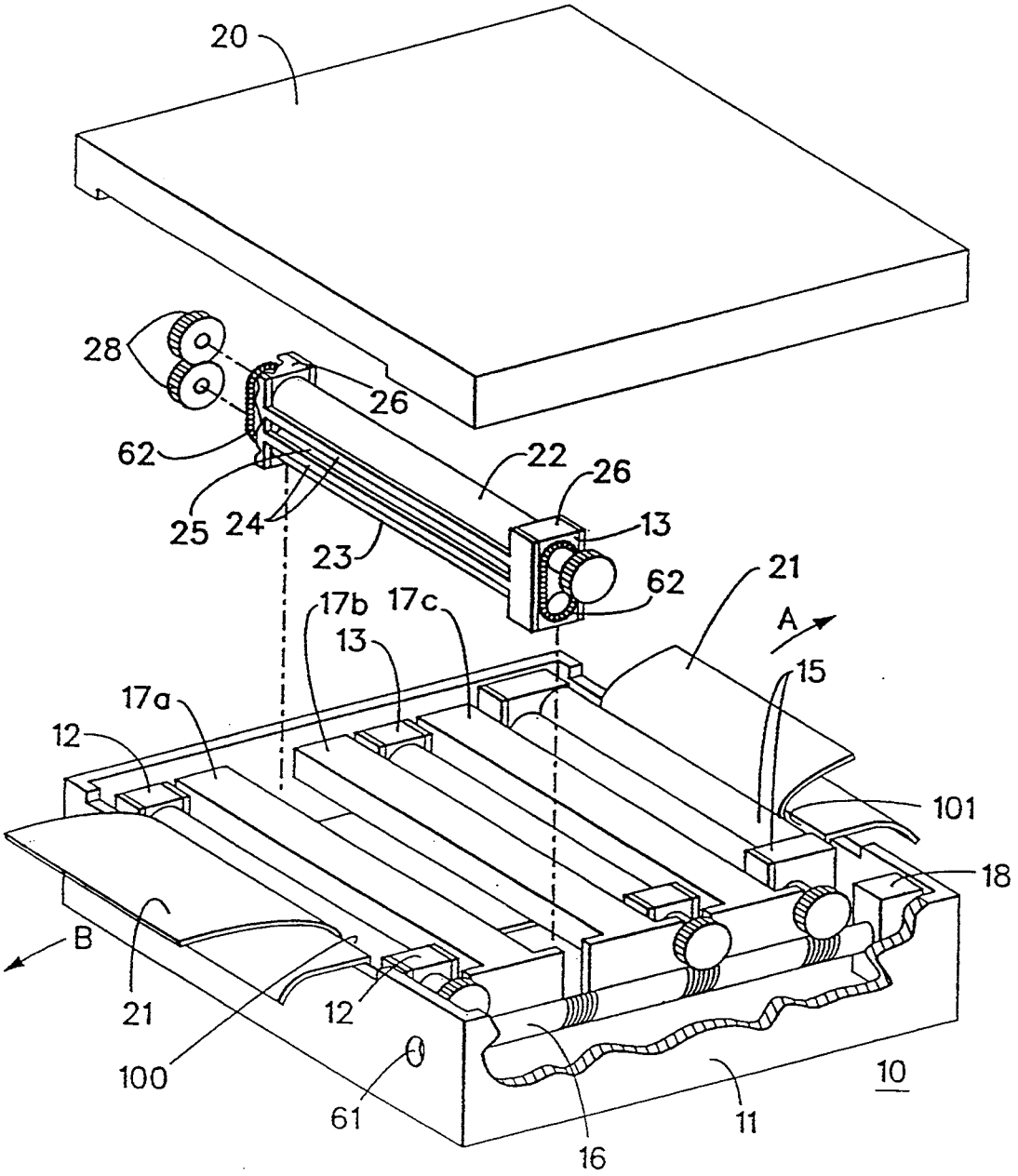
FIG. 1 is a perspective drawing of module 10.

Referring now to the drawings in detail, and more particularly to FIG. 1, the reference character 10 represents a processing module, which may stand alone or be easily combined or adjoined with other processing modules 10 to form a continuous low volume unit for processing photosensitive materials.

Processing module 10 includes: a container 11; an upturned entrance channel 100 (described in the description of FIG. 2); an entry transport roller assembly 12; transport roller assemblies 13; an exit transport roller assembly 15; an upturned exit channel 101 (described in the description of FIG. 2); high impingement slot nozzles 17*a*, 17*b* and 17*c*; a drive 16 and a rotating assembly 18, assembly 18 may be any known means for turning drive 16, i.e., a motor, a gear, a belt, a chain, etc. An access hole 61 is provided in container 11. Hole 61 is utilized for the interconnection of modules 10. Assemblies 12, 13 and 15 are positioned within container 11 in the vicinity of the walls of container 11 and slot nozzles 17*a*, 17*b* and 17*c* are positioned within the vicinity of the walls of container 11. Drive 16 is connected to roller assemblies 12, 13 and 15 and turning assembly 18 and assembly 16 is used to transmit the motion of assembly 18 to assemblies 12, 13 and 15.

Roller assemblies 12, 13, and 15, and slot nozzles 17*a*, 17*b* and 17*c* may be easily inserted into or removed from container 11. Roller assembly 13 includes: a top roller 22; a bottom roller 23; tension springs 62, which holds top roller 22 in compression with respect to bottom roller 23; a bearing bracket 26; and a channel section 24 having a thin low volume processing channel 25. A narrow channel opening 27 exists within section 24. Opening 27 on the entrance side of section 24 may be the same size and shape as opening 27 on the exit side of section 24. Opening 27 on the entrance side of section 24 may also be relieved, tapered or larger than the exit side of section 24 to accommodate rigidity variations of various types of photosensitive material 21. Channel opening 27 forms a portion of processing channel 25. Rollers 22 and 23 may be drive or driven rollers and rollers 22 and 23 are connected to bracket 26. Rollers 22 and 23 are rotated by intermeshing gears 28.

Photosensitive material 21 is transported in either direction A or direction B automatically through processing channel 25 by roller assemblies 12, 13 and 15. Photosensitive material 21 may be in a cut sheet or roll format or photosensitive material 21 may be simultaneously in a roll and simultaneously in a cut sheet format. Photosensitive material 21 may contain an emulsion on either or both of its surfaces.

When cover 20 is placed on container 11 a light tight enclosure is formed. Thus, module 10 with its associated recirculation system 60, which is described in the description of FIG. 5, will be a stand alone light tight module that is capable of processing photosensitive material, i.e., a monobath. When two or more modules 10 are combined a multi-stage continuous processing unit may be formed. The combination of one or more modules 10 will be more fully set forth in the description of FIG. 6.

Figure 2:
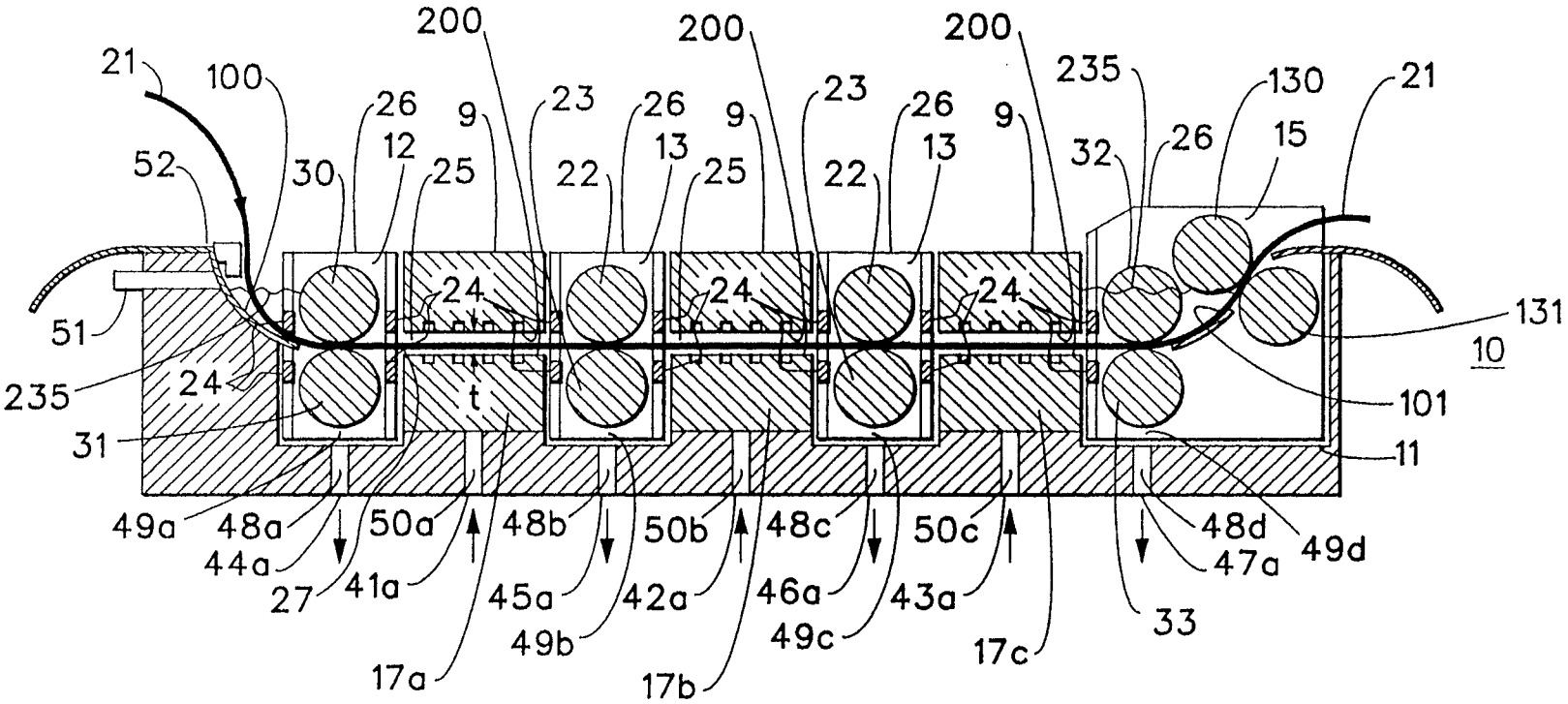
FIG. 2 is a partially cut away drawing of module 10 in which material 21 has an emulsion on one surface and nozzles 17*a*, 17*b* and 17*c* are on the bottom portion of container 11 facing the emulsion surface of material 21.

FIG. 2 is a partially cut away section of module 10 of FIG. 1. Assemblies 12, 13 and 15, nozzles 17*a*, 17*b* and 17*c* and backing plate 9 are designed in a manner to minimize the amount of processing solution that is contained in processing channel 25, vessel 11, recirculation system 60 (FIG. 5) and gaps 49*a*, 49*b*, 49*c* and 49*d*. At the entrance of module 10, an upturned channel 100 forms the entrance to processing channel 25. At the exit of module 10, an upturned channel 101 forms the exit to processing channel 25. Assembly 12 is similar to assembly 13. Assembly 12 includes: a top roller 30; a bottom roller 31; tension springs 62 (not shown) which holds top roller 30 to bottom roller 31; a bearing bracket 26; and a channel section 24. A portion of narrow processing channel 25 is formed by channel section 24. Rollers 30 and 31 may be drive or driven rollers and rollers 30 and 31 are connected to bracket 26. Assembly 15 is similar to assembly 13, except that assembly 15 has an additional two rollers 130 and 131, which operate in the same manner as rollers 32 and 33. Assembly 15 includes: a top roller 32; a bottom roller 33; tension springs 62 (not shown); a top roller 130; a bottom roller 131; a bearing bracket 26; and a channel section 24. A portion of narrow processing channel 25 exists within section 24. Channel section 24 forms a portion of processing channel 25. Rollers 32, 33, 130 and 131 may be drive or driven rollers and rollers 32, 33, 130 and 131 are connected to bracket 26.

Backing plate 9 and slot nozzles 17*a*, 17*b* and 17*c* are affixed to container 11. The embodiment shown in FIG. 2 will be used when photosensitive material 21 has an emulsion on one of its surfaces. The emulsion side of material 21 will face slot nozzles 17*a*, 17*b* and 17*c*. Material 21 enters channel 25 between rollers 30 and 31 and moves past backing plate 9 and nozzle 17*a*. Then material 21 moves between rollers 22 and 23 and moves past backing plates 9 and nozzles 17*b* and 17*c*. At this point material 21 will move between rollers 32 and 33, and move between rollers 130 and 131 and exit processing channel 25.

Figure 5:
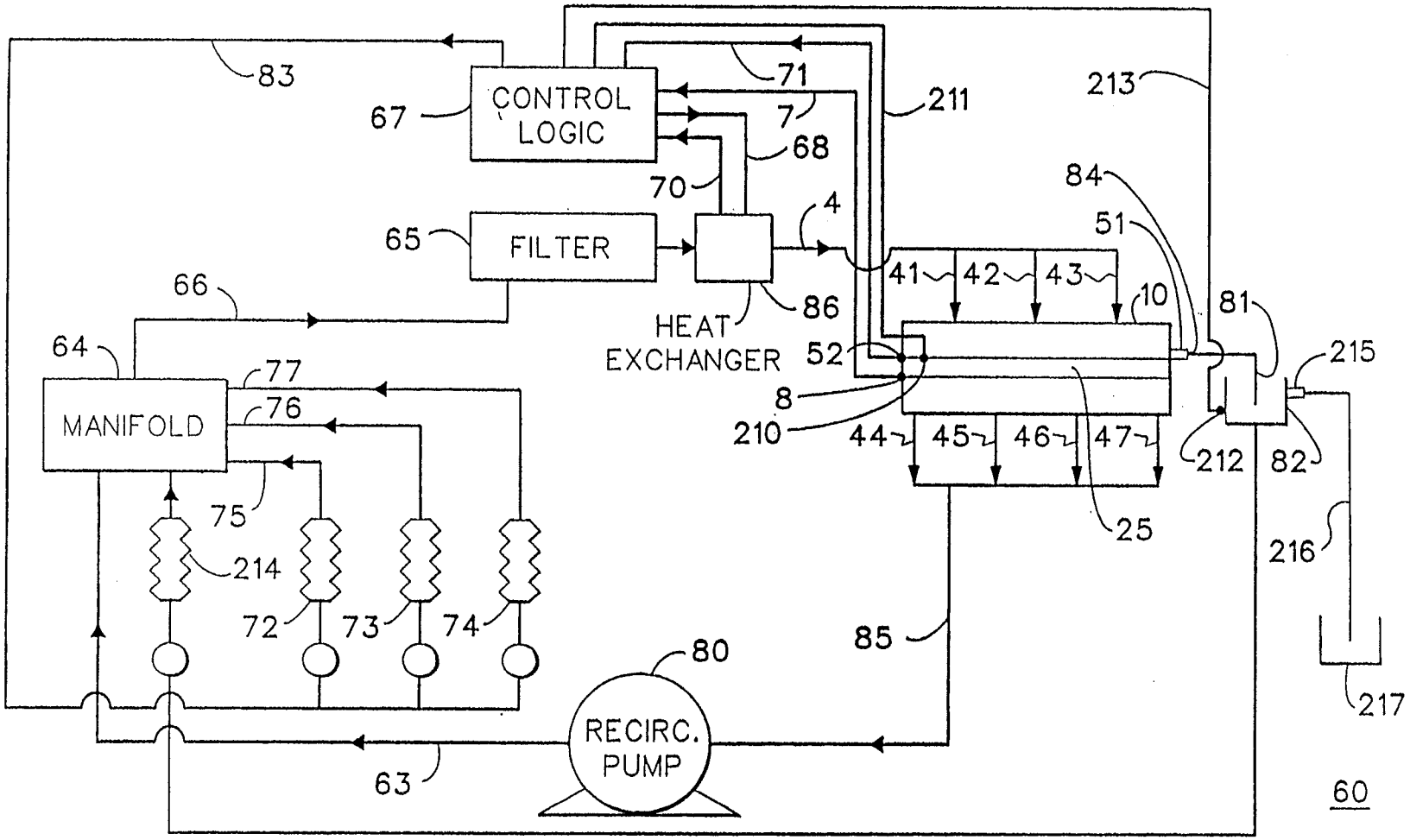
FIG. 5 is a schematic drawing of the processing solution recirculation system of the apparatus of this invention.

Conduit 48*a* connects gap 49*a*, via port 44*a* to recirculation system 60 via port 44 (FIG. 5), which is more fully described in the description of FIG. 5, and conduit 48*b* connects gap 49*b*, via port 45*a* to recirculation system 60 via port 45 (FIG. 5). Conduit 48*c* connects gap 49*c*, via port 46*a* to recirculation system 60 via port 46 (FIG. 5) and conduit 48*d* connects gap 49*d*, via port 47*a* to recirculation system 60 via port 47 (FIG. 5). Slot nozzle 17*a* is connected to recirculation system 60 via conduit 50*a* and inlet port 41*a* via port 44 (FIG. 5) and slot nozzle 17*b* is connected to recirculation system 60 via conduit 50*b* and inlet port 42*a* via inlet port 42 (FIG. 5). Conduit 50*c* connects nozzle 17*c*, via inlet port 43*a* to recirculation system 60 via port 43 (FIG. 5). Sensor 52 is connected to container 11 and sensor 52 is used to maintain a processing solution level 235 relative to conduit 51. Excess processing solution may be removed by overflow conduit 51.

Textured surface 200 or 205 is affixed to the surface of backing plate 9 that faces processing channel 25 and to the surface of slot nozzles 17*a*, 17*b* and 17*c* that faces processing channel 25.

Figure 3:
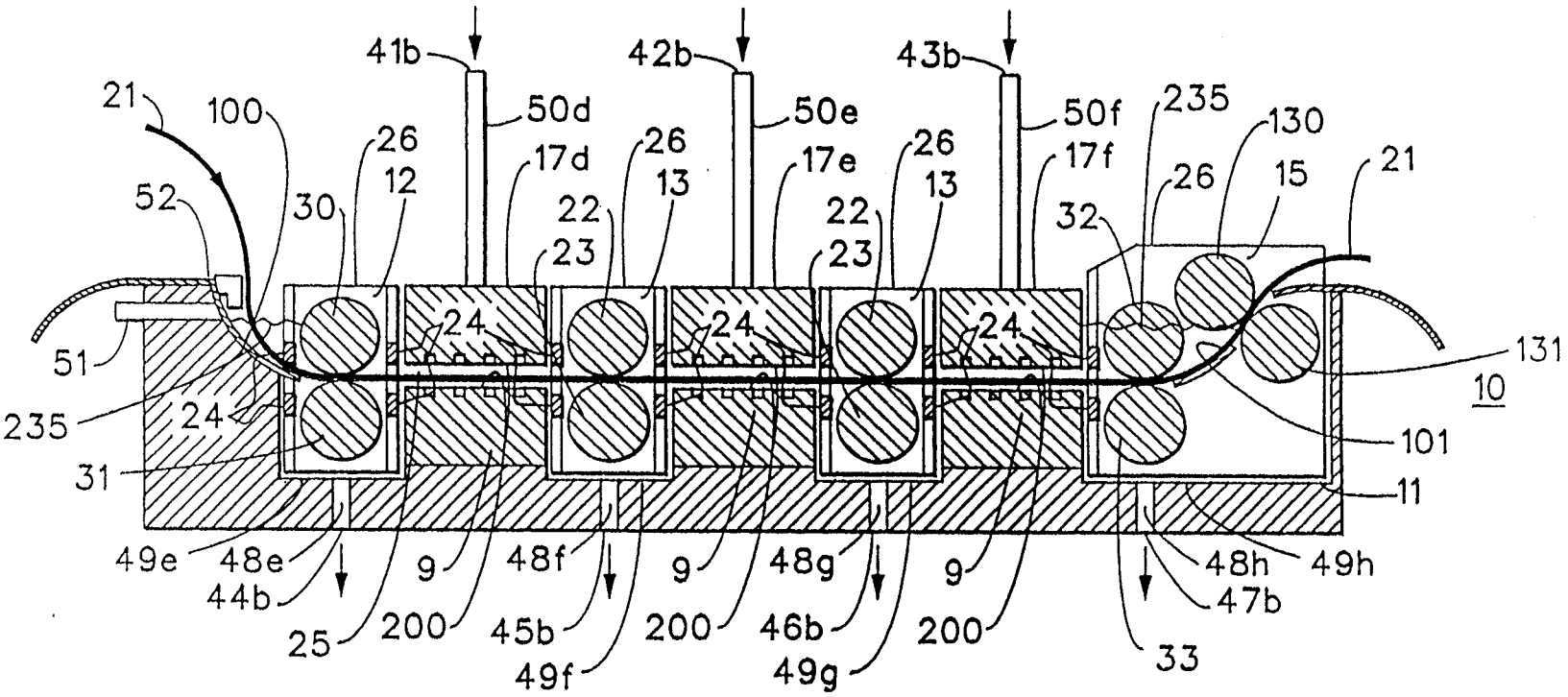
FIG. 3 is a partially cut away drawing of an alternate embodiment of module 10 of FIG. 2 in which material 21 has an emulsion on one surface and nozzles 17*d*, 17*e* and 17*f* are on the top portion of container 11 facing the emulsion surface of material 21.

FIG. 3 is a partially cut away drawing of an alternate embodiment of module 10 of FIG. 2 in which material 21 has an emulsion on one surface and nozzles 17*d*, 17*e* and 17*f* are on the top portion of container 11. Assemblies 12, 13 and 15, nozzles 17*d*, 17*e* and 17*f* and backing plate 9 are designed in a manner to minimize the amount of processing solution that is contained in processing channel 25 and gaps 49*e*, 49*f*, 49*g* and 49*h*. At the entrance of module 10, an upturned channel 100 forms the entrance to processing channel 25. At the exit of module 10, an upturned channel 101 forms the exit to processing channel 25. Assembly 12 is similar to assembly 13. Assembly 12 includes: a top roller 30; a bottom roller 31; tension springs 62 (not shown) which holds top roller 30 in compression with respect to bottom roller 31, a bearing bracket 26; and a channel section 24. A portion of narrow channel opening 25 exists within section 24. Channel section 24 forms a portion of processing channel 25. Rollers 30 and 31 may be drive or driven rollers and rollers 30 and 31 are connected to bracket 26. Assembly 15 is similar to assembly 13, except that assembly 15 has an additional two rollers 130 and 131 that operate in the same manner as rollers 32 and 33. Assembly 15 includes: a top roller 32; a bottom roller 33; a tension spring 62 (not shown); a top roller 130; a bottom roller 131; a bearing bracket 26; and a channel section 24. A portion of narrow processing channel 25 exists within section 24. Channel section 24 forms a portion of processing channel 25. Rollers 32, 33, 130 and 131 may be drive or driven rollers and rollers 32, 33, 130 and 131 are connected to bracket 26. Thus, it can be seen that a substantially continuous processing channel is provided.

Backing plate 9 and slot nozzles 17*d*, 17*e* and 17*f* are affixed to container 11. The embodiment shown in FIG. 3 will be used when photosensitive material 21 has an emulsion on one of its surfaces. The emulsion side of material 21 will face slot nozzles 17*d*, 17*e* and 17*f*. Material 21 enters channel 25 between rollers 30 and 31 and moves past backing plate 9 and nozzle 17*d*. Then material 21 moves between rollers 22 and 23 and moves past backing plates 9 and nozzles 17*e* and 17*f*. At this point material 21 will move between rollers 32 and 33 and move between rollers 130 and 131 and exit processing channel 25.

Conduit 48*e* connects gap 49*e*, via port 44*b* to recirculation system 60 via port 44 (FIG. 5) and conduit 48*f* connects gap 49*f*, via port 45*b* to recirculation system 60 via port 45 (FIG. 5). Conduit 48*g* connects gap 49*g*, via port 46*b* to recirculation system 60 via port 46 (FIG. 5) and conduit 48*h* connects gap 49*h*, via port 47*b* to recirculation system 60 via port 47 (FIG. 5). Slot nozzle 17*d* is connected to recirculation system 60 via conduit 50*d* and inlet port 41*b* via inlet 41 (FIG. 5) and slot nozzle 17*e* is connected to recirculation system 60 via conduit 50*e* and inlet port 42*b* via port 42 (FIG. 5). Conduit 50*f* connects nozzle 17*f*, via inlet port 43*b* to recirculation system 60 via port 43 (FIG. 5). Sensor 52 is connected to container 11 and sensor 52 is used to maintain a processing solution level 235 relative to conduit 51. Excess processing solution may be removed by overflow conduit 51.

Textured surface 200 or 205 is affixed to the surface of backing plate 9 that faces processing channel 25 and to the surface of slot nozzles 17*d*, 17*e* and 17*f* that faces processing channel 25.

Figure 4:
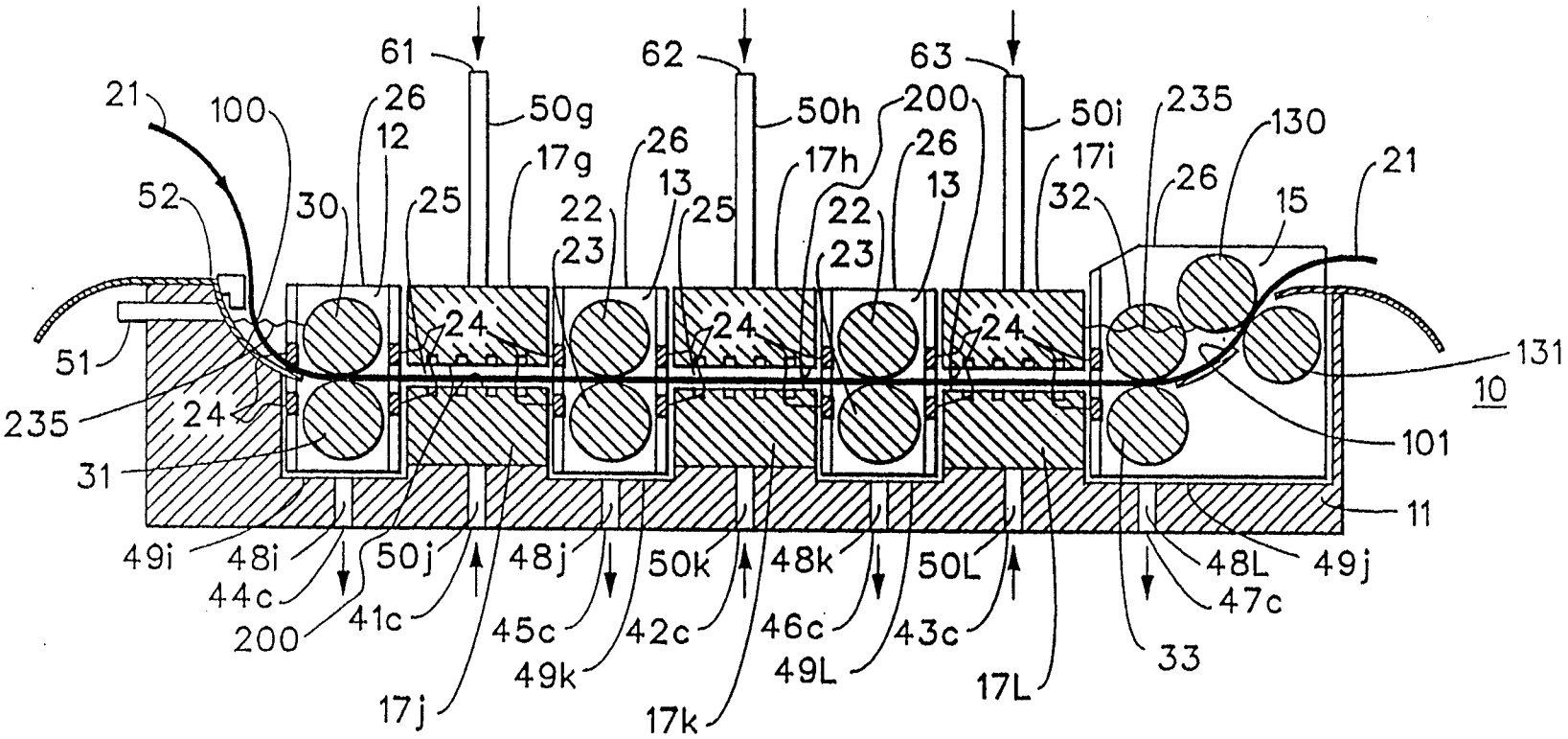
FIG. 4 is a partially cut away drawing of an alternate embodiment of module 10 of FIG. 2 in which material 21 has an emulsion on both surfaces and nozzles 17*g*, 17*h* and 17*i* are on the top portion of container 11 facing one emulsion surface of material 21 and nozzles 17*j*, 17*k*, and 17L are on the bottom portion of container 11 facing the other emulsion surface of material 21.

FIG. 4 is a partially cut away drawing of an alternate embodiment of module 10 of FIG. 2 in which material 21 has an emulsion on both surfaces and nozzles 17*g*, 17*h* and 17*i* are on the top portion of container 11 facing one emulsion surface of material 21 and nozzles 17*j*, 17*k*, and 17L are on the bottom portion of container 11 facing the other emulsion surface of material 21. Assemblies 12, 13 and 15, nozzles 17*g*, 17*h*, 17*i*, 17*j*, 17*k* and 17L are designed in a manner to minimize the amount of processing solution that is contained in processing channel 25 and gaps 49*i*, 49*j*, 49*k* and 49L. At the entrance of module 10, an upturned channel 100 forms the entrance to processing channel 25. At the exit of module 10, an upturned channel 101 forms the exit to processing channel 25. Assembly 12 includes: a top roller 30; a bottom roller 31; tension springs 62 (not shown) which holds top roller 30 in compression with respect to bottom roller 31, a bearing bracket 26; and a channel section 24. A portion of narrow processing channel 25 exists within section 24. Channel section 24 forms a portion of processing channel 25. Rollers 30, 31, 130 and 131 may be drive or driven rollers and rollers 30, 31, 130 and 131 are connected to bracket 26. Assembly 15 is similar to assembly 13, except that assembly 15 has an additional two rollers 130 and 131 that operate in the same manner as rollers 32 and 33. Assembly 15 includes: a top roller 32; a bottom roller 33; tension springs 62 (not shown); a top roller 130; a bottom roller 131; a bearing bracket 26; and a channel section 24. A portion of narrow processing channel 25 exists within section 24. Channel section 24 forms a portion of processing channel 25. Rollers 32, 33, 130 and 131 may be drive or driven rollers and rollers 32, 33, 130 and 131 are connected to bracket 26.

Slot nozzles 17*g*, 17*h* and 17*i* are affixed to the upper portion of container 11. Slot nozzles 17*j*, 17*k* and 17L are affixed to the lower portion of container 11. The embodiment shown in FIG. 4 will be used when photosensitive material 21 has an emulsion on both of its two surfaces. One emulsion side of material 21 will face slot nozzles 17*g*, 17*h* and 17*i* and the other emulsion side of material 21 will face slot nozzles 17*j*, 17*k* and 17L. Material 21 enters channel 25 between rollers 30 and 31 and moves past and nozzles 17*g* and 17*j*. Then material 21 moves between rollers 22 and 23 and moves past nozzles 17*h*, 17*k*, 17*i* and 17L. At this point material 21 will move between rollers 32 and 33 and move between rollers 130 and 131 and exit processing channel 25.

Conduit 48*i* connects gap 49*i*, via port 44*c* to recirculation system 60 via port 44 (FIG. 5) and conduit 48*j* connects gap 49*k*, via port 45*c* to recirculation system 60 via port 45 (FIG. 5). Conduit 48*k* connects gap 49L, via port 46*c* to recirculation system 60 and conduit 48L connects gap 49*j*, via port 47*c* to recirculation system 60 via port 47 (FIG. 5). Slot nozzle 17*g* is connected to recirculation system 60 via conduit 50*g* via port 41 (FIG. 5). Slot nozzle 17*h* is connected to recirculation system 60 via conduit 50*h* and inlet port 62 via port 42 (FIG. 5). Conduit 50*i* connects nozzle 17*i*, via inlet port 63 to recirculation system 60 via port 43 (FIG. 5). Slot nozzle 17*j* is connected to recirculation system 60 via conduit 50*j* and inlet port 41*c* via port 41 (FIG. 5) and slot nozzle 17*k* is connected to recirculation system 60 via conduit 50*k* and inlet port 42*c* via port 42 (FIG. 5). Slot nozzle 17L is connected to recirculation system 60 via conduit 50L and inlet port 43*c* via port 43 (FIG. 5). Sensor 52 is connected to container 11 and sensor 52 is used to maintain a processing solution level 235 relative to conduit 51. Excess processing solution may be removed by overflow conduit 51. Material 21 enters upturned channel entrance 100, then passes through channel section 24 of channel 25 between rollers 30 and 31 and moves past nozzles 17*g* and 17*j*. Then material 21 moves between rollers 22 and 23 and moves past nozzles 17*h* and 17*k*, 17L and 17*i*. At this point material 21 will move between rollers 32 and 33 and exit processing channel 25.

Conduit 48*i* connects gap 49*i*, via port 44*c* to recirculation system 60 via port 44 (FIG. 5) and conduit 48*j* connects gap 49*k*, via port 45*c* to recirculation system 60 via port 45 (FIG. 5). Conduit 48*k* connects gap 49L, via port 46*c* to recirculation system 60 via port 46 (FIG. 5) and conduit 48L connects gap 49*j*, via port 47*c* to recirculation system 60 via port 47 (FIG. 5). Sensor 52 is connected to container 11 and sensor 52 is used to maintain a level of processing solution relative to conduit 51. Excess processing solution may be removed by overflow conduit 51.

Textured surface 200 or 205 is affixed to the surface of slot nozzles 17*g*, 17*h*, 17*i*, 17*j*, 17*k* and 17L that face processing channel 25.

FIG. 5 is a schematic drawing of the processing solution recirculation system 60 of the apparatus of this invention. Module 10 is designed in a manner to minimize the volume of channel 25. The outlets 44, 45, 46 and 47 of module 10 are connected to recirculating pump 80 via conduit 85. Recirculating pump 80 is connected to manifold 64 via conduit 63 and manifold 64 is coupled to filter 65 via conduit 66. Filter 65 is connected to heat exchanger 86 and heat exchanger 86 is connected to channel 25 via conduit 4. Control logic 67 is connected to heat exchanger 86 is connected to control logic 67 via wire 68. Control logic 67 is connected to heat exchanger 86 via wire 70 and sensor 52 is connected to control logic 86 via wire 71. Metering pumps 72, 73 and 74 are respectively connected to manifold 64 via conduits 75, 76 and 77. Thus, it can be seen that processing solution is pumped directly from the outlet passages to the inlet ports without use of a reservoir.

The photographic processing chemicals that comprise the photographic solution are placed in metering pumps 72, 73 and 74. Pumps 72, 73 and 74 are used to place the correct amount of chemicals in manifold 64, when photosensitive material 210 sensor senses that material 21 (FIG. 1) is entering channel 25. Sensor 210 transmits a signal to pumps 72, 73 and 74 via line 211 and control logic 67. Manifold 64 introduces the photographic processing solution into conduit 66.

The photographic processing solution flows into filter 65 via conduit 66. Filter 65 removes contaminants and debris that may be contained in the photographic processing solution. After the photographic processing solution has been filtered, the solution enters heat exchanger 86.

Sensor 52 senses the solution level and sensor 8 senses the temperature of the solution and respectively transmits the solution level and temperature of the solution to control logic 67 via wires 71 and 7. For example, control logic 67 is the series CN 310 solid state temperature controller manufactured by Omega Engineering, Inc. of 1 Omega Drive, Stamford, Conn. 06907. Logic 67 compares the solution temperature sensed by sensor 8 and the temperature that exchanger 86 transmitted to logic 67 via wire 70. Logic 67 will inform exchanger 86 to add or remove heat from the solution. Thus, logic 67 and heat exchanger 86 modify the temperature of the solution and maintain the solution temperature at the desired level.

Sensor 52 senses the solution level in channel 25 and transmits the sensed solution level to control logic 67 via wire 71. Logic 67 compares the solution level sensed by sensor 52 via wire 71 to the solution level set in logic 67. Logic 67 will inform pumps 72, 73 and 74 via wire 83 to add additional solution if the solution level is low. Once the solution level is at the desired set point control logic 67 will inform pumps 72, 73 and 74 to stop adding additional solution.

Any excess solution may either be pumped out of module 10 or removed through level drain overflow 84 via conduit 81 into container 82.

At this point the solution enters module 10 via inlets 41, 42 and 43. When module 10 contains too much solution the excess solution will be removed by overflow conduit 51, drain overflow 84 and conduit 81 and flow into reservoir 82. The solution level of reservoir 82 is monitored by sensor 212. Sensor 212 is connected to control logic 67 via line 213. When sensor 212 senses the presence of solution in reservoir 82, a signal is transmitted to logic 67 via line 213 and logic 67 enables pump 214. Thereupon, pump 214 pumps solution into manifold 64. When sensor 212 does not sense the presence of solution, pump 214 is disabled by the signal transmitted via line 213 and logic 67. When solution in reservoir 82 reaches overflow 215 the solution will be transmitted through conduit 216 into reservoir 217. The remaining solution will circulate through channel 25 and reach outlet lines 44, 45, 46 and 47. Thereupon, the solution will pass from outlet lines 44, 45, 46 and 47 to conduit line 85 to recirculation pump 80. The photographic solution contained in the apparatus of this invention, when exposed to the photosensitive material, will reach a seasoned state more rapidly than prior art systems, because the volume of the photographic processing solution is less.

Figure 6:
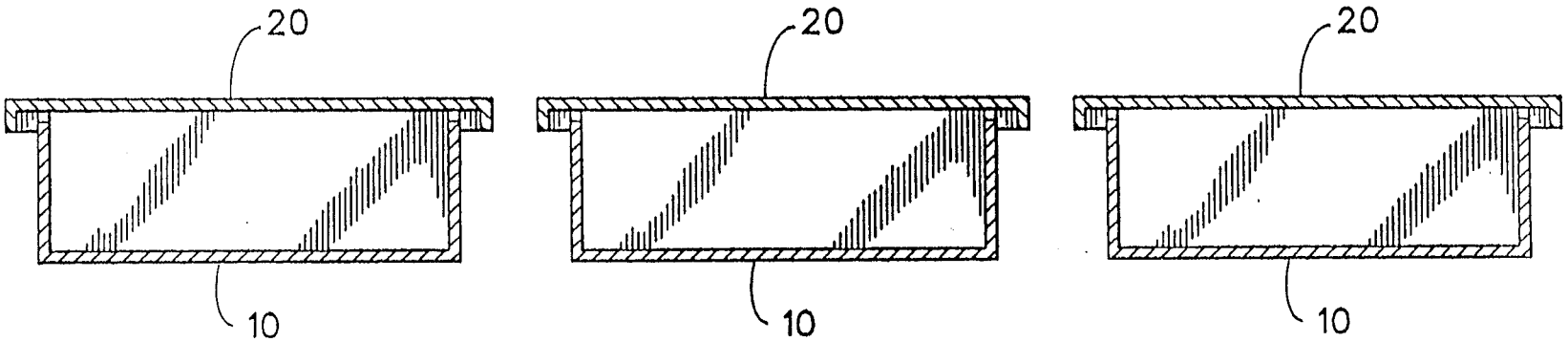
FIG. 6 is a drawing that shows the interconnection of modules 10 to form a continuous photographic processor.

FIG. 6 is a drawing that shows the interconnection of a plurality of modules 10 to form a continuous photographic processor. Modules 10 may contain the same or similar processing solution to increase the productivity of the processor or perform different processing functions by containing different processing solutions. Any number of modules 10 may be interconnected, only three have been shown for illustrative purposes. Drive 16 from each of the modules 10 is interconnected via drive access hole 61, by any known means, i.e., couplings, keyways, belts, chains, hex drives, etc. Photosensitive material 21 travels from module 10 to module 10 via light tight interconnecting cross over 220. Modules 10 are physically connected to each other by any known mechanical fastening means, i.e. belts, screws, snaps, rivets etc.

Figure 7:
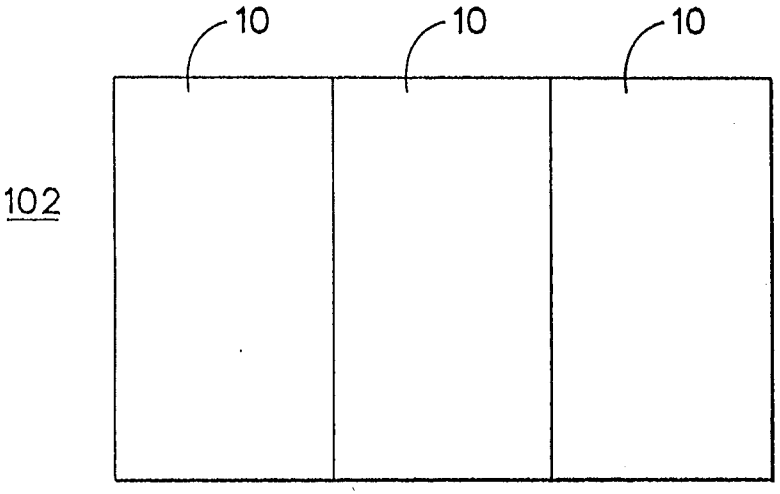
FIG. 7 is a drawing that shows the integration of modules 10 into a single body to form a continuous photographic processor.

FIG. 7 is a drawing that shows the integration of a plurality of modules 10 into a single body 102 to form a continuous photographic processor, that contains more than one channel. Each module 10 may contain one or more roller assemblies and slot nozzles 17 in order to form a continuous photographic processor. Modules 10 may contain the same or similar processing solution to increase the productivity of the processor or perform different processing functions by containing different processing solutions. Any number of modules 10 may be interconnected, only three have been shown for illustrative purposes. Drive 16 (FIG. 1) from each of the modules 10 is interconnected via drive access hole 61, by any known means, i.e., couplings, keyways, belts, chains, hex drives, etc. Modules 10 are physically connected to each other by any known mechanical fastening means, i.e., belts, screws, snaps, rivets etc.

A processor made in accordance with the present invention provides a small volume for holding processing solution. As a part of limiting the volume of the processing solution, a narrow processing channel is provided. The processing channel 25, for a processor used for photographic paper, should have a thickness t equal to or less than about 50 times the thickness of paper being processed, preferably the thickness t is equal to or less than about 10 times the paper thickness. In a processor for processing photographic film, the thickness t of the processing channel 25 should be equal to or less than about 100 times the thickness of photosensitive film, preferably, equal to or less than about 18 times the thickness of the photographic film. An example of a processor made in accordance with the present invention which processes paper having a thickness of about 0.008 inches would have a channel thickness t of about 0.080 inches and a processor which process film having a thickness of about 0.0055 inches would have a channel thickness t of about 0.10 inches.

The total volume of the processing solution within the processing channel 25 and recirculation system 60 is relatively smaller as compared to prior art processors. In particular, the total amount of processing solution in the entire processing system for a particular module is such that the total volume in the processing channel 25 is at least 40 percent of the total volume of processing solution in the system. Preferably, the volume of the processing channel 25 is at least about 50 percent of the total volume of the processing solution in the system. In the particular embodiment illustrated, the volume of the processing channel is about 60 percent of total volume of the processing solution.

Typically the amount of processing solution available in the system will vary on the size of the processor, that is, the amount of photosensitive material the processor is capable of processing. For example, a typical prior art microlab processor, a processor that processes up to about 5 $ft^2$/min. of photosensitive material (which generally has a transport speed less than about 50 inches per minute) has about 17 liters of processing solution as compared to about 5 liters for a processor made in accordance with the present invention. With respect to typical prior art minilabs, a processor that processes from about 5 $ft^2$/min. to about 15 $ft^2$/min. of photosensitive material (which generally has a transport speed from about 50 inches/min. to about 120 inches/min.) has about 100 liters of processing solution as compared to about 10 liters for a processor made in accordance with the present invention. With respect to large prior art lab processors that process up to 50 $ft^2$/min. of photosensitive material (which generally have transport speeds of about 7 to 60 ft/min.) typically have from about 150 to 300 liters of processing solution as compared to a range of about 15 to 100 liters for a large processor made in accordance with the present invention. In a minilab size processor made in accordance with the present invention designed to process 15 $ft^2$ of photosensitive material per min. would have about 7 liters of processing solution as compared to about 17 liters for a typical prior art processor.

In certain situations it may be appropriate to provide a sump in the conduits **48*a*-1 and/or gaps 49*a*-1 so that vortexing of the processing solution will not occur. The size and configuration of the sump will, of course, be dependent upon the rate at which the processing solution is recirculated and the size of the connecting passages which form part of the recirculatory system. It is desirable to make the connecting passages as small as possible, yet, the smaller the size of the passages, for example, in the conduits 48*a*-1 from the gaps 49*a*-1 to the pump, the greater likelihood that vortexing may occur. For example, in a processor having a recirculatory rate of approximately 3 to 4 gallons per minute, there is preferably provided a sump such that a head pressure of approximately 4 inches at the exit of the tray to the recirculating pump can be maintained without causing vortexing. The sump need only be provided in a localized area adjacent the conduits 48*a*-1** of the tray. Thus, it is important to try to balance the low amount of volume of the processing solution available to the flow rate required of the processor.

In order to provide efficient flow of the processing solution through the nozzles into the processing channel, it is desirable that the nozzles/openings that deliver the processing solution to the processing channel have a configuration in accordance with the following relationship:

$$1 \leqq F/A \leqq 40$$

wherein:

F is the flow rate of the solution through the nozzle in gallons per minute; and A is the cross-sectional area of the nozzle provided in square inches.

Providing a nozzle in accordance with the foregoing relationship assures appropriate discharge of the processing solution against the photosensitive material.

The above specification describes a new and improved apparatus for processing photosensitive materials. It is realized that the above description may indicate to those skilled in the art additional ways in which the principles of this invention may be used without departing from the spirit. It is, therefore, intended that this invention be limited only by the scope of the appended claims.

| Parts List: | |
|---|---|
| 4 | conduit |
| 7 | wire |
| 8 | sensor |
| 9 | backing plate |
| 10 | processing module |
| 11 | container |
| 12 | transport roller assembly |
| 13 | transport roller assembly |
| 15 | transport roller assembly |
| 16 | drive |
| 17a–l | nozzles |
| 18 | rotating assembly |
| 20 | cover |

-continued

| Parts List: | |
|---|---|
| 21 | photosensitive material |
| 22 | roller |
| 23 | roller |
| 24 | channel section |
| 25 | processing channel |
| 26 | bearing bracket |
| 27 | opening |
| 28 | intermeshing gears |
| 30 | roller |
| 31 | roller |
| 32 | roller |
| 33 | roller |
| 41 | port |
| 41a–c | inlet port |
| 42 | port |
| 42a–c | inlet port |
| 43 | port |
| 43a–c | inlet port |
| 44 | port |
| 44a–c | port |
| 45 | port |
| 45a–c | port |
| 46 | port |
| 46a–c | port |
| 47 | port |
| 47a–c | port |
| 48a–l | conduit |
| 49a–l | gap |
| 50a–l | conduit |
| 51 | overflow conduit |
| 52 | sensor |
| 60 | recirculation system |
| 61 | access hole |
| 62 | tension springs |
| 63 | conduit |
| 64 | manifold |
| 65 | filter |
| 66 | conduit |
| 67 | control logic |
| 68 | wire |
| 70 | wire |
| 71 | wire |
| 72 | metering pump |
| 73 | metering pump |
| 74 | metering pump |
| 75 | conduit |
| 76 | conduit |
| 77 | conduit |
| 80 | recirculating pump |
| 81 | conduit |
| 82 | container |
| 83 | wire |
| 84 | drain overflow |
| 85 | conduit |
| 86 | heat exchanger |
| 100 | entrance channel |
| 101 | exit channel |
| 102 | single body |
| 130 | roller |
| 131 | roller |
| 200 | textured surface |
| 205 | textured surface |
| 210 | sensor |
| 211 | line |
| 212 | sensor |
| 213 | line |
| 214 | pump |
| 215 | overflow |
| 216 | conduit |
| 217 | reservoir |
| 235 | solution level |

What is claimed is:

1. An apparatus for processing photosensitive materials, the apparatus comprising:

a processing module comprising a container and at least one processing assembly placed in the container, the at least one processing assembly forming a processing channel through which a processing solution flows, the processing channel comprising at least 40% of the total volume of processing solution available for the processing module and having a thickness equal to or less than about 100 times the thickness of the photosensitive material to be processed in the processing channel;

transport means for transporting the photosensitive material from the channel entrance through the channel to the channel exit; and means for circulating the processing solution through the small volume provided in the processing channel.

2. The apparatus according to claim 1 wherein said processing channel comprises at least 50% of the total volume of the processing solution for the processing module.

3. The apparatus according to claim 1 wherein said processing channel comprises at least 60% of the total volume of the processing solution for the processing module.

4. An apparatus according to claim 1 wherein said processing channel has a thickness equal to or less than about 50 times the thickness of the photosensitive material.

5. An apparatus according to claim 1 wherein said processing channel has a thickness equal to or less than about 18 times the thickness of the photosensitive material.

6. An apparatus according to claim 1 wherein said processing channel has a thickness equal to or less than about 10 times the thickness of the photosensitive material.

7. The apparatus claimed in claim 1, wherein a plurality of apparatus are interconnected to form a multi-step processor.

8. The apparatus claimed in claim 1, wherein a plurality of apparatus are integrated into one body to form a multi-step processor.

9. The apparatus claimed in claim 1, wherein said circulation means comprises:

a pump for recirculating the processing solution;

conduits connected to said pump, said container and said channel for transporting the processing solution; and a filter connected to said conduit for removing contaminants from the processing solution, wherein the processing solution volume contained in said pump, said conduits and said filter does not exceed the small volume for holding processing solution.

10. The apparatus claimed in claim 9, further including a heat exchanger that rapidly regulates the temperature of the processing solution.

11. The apparatus claimed in claim 9, further including:

a plurality of metering pumps for metering specified amounts of chemicals; and a manifold coupled to said conduit and said metering pumps for dispensing additional processing solution to the processing channel.

12. The apparatus claimed in claim 11, wherein said containers have an overflow conduit coupled to a reservoir to maintain a consistent processing solution level.

13. The apparatus claimed in claim 1, wherein said transporting means comprises:

a plurality of rollers for moving the photosensitive material through the processing channel.

14. The apparatus claimed in claim 13, wherein said rollers are sized to displace a large amount of processing solution.

15. The apparatus claimed in claim 1, wherein said transporting means comprises a plurality of rollers and one or more spring loaded rollers.

16. The apparatus claimed in claim 15, wherein said spring loaded rollers comprises:

a driving roller;

a driven roller connected to said driving roller; and a spring connected to said driven roller and said driving roller.

17. The apparatus claimed in claim 16 wherein said drive and driven rollers are positively interconnected so that said drive and driven rollers will move in synchronization.

18. The apparatus claimed in claim 16, wherein said drive and driven rollers form a removable unit.

19. An apparatus for processing photosensitive materials, the apparatus comprising:

a processing module comprising a container having at least one processing assembly placed in said container and at least one transport assembly disposed adjacent said at least one processing assembly, said at least one processing assembly and said at least one transport assembly forming a substantially continuous channel through which a processing solution flows, said processing channel comprising at least 40% of the total volume of processing solution available for the processing module and having a thickness equal to or less than about 100 times the thickness of the photosensitive material to be processed in said processing channel;

at least one discharge opening is provided in said at least one transport assembly or said at least one processing assembly for introducing processing solution to said processing channel;

at least one outlet for allowing processing solution to exit said processing channel and said module; and means for circulating the processing solution from said at least one outlet provided in said module directly to said at least one discharge opening.

20. The apparatus claimed in claim 19 wherein said at least one discharge opening has a configuration in accordance with the following relationship:

$$1 \leqq F/A \leqq 40$$

wherein:

F is the flow rate of the solution through the discharge opening in gallons per minute; and A is the cross-sectional area of the nozzle provided in square inches.

21. An apparatus for processing photosensitive materials, said apparatus comprising:

a processing module comprising a container having at least one processing assembly placed in said container, said at least one processing assembly forming a channel through which a processing solution flows, said channel having an entrance and an exit and at least one discharge opening is provided in said at least one processing assembly for introducing processing solution to said channel;

transport means for transporting the photosensitive material from said channel entrance through said channel to the channel exit, said transport means being disposed adjacent said at least one processing assembly and forming a portion of said processing channel, said processing channel comprising at least 40% of the total volume of processing solution available for the processing module and having a thickness equal to or less than about 100 times the thickness of the photosensitive material to be processed in said processing channel; and means for circulating the processing solution through the processing channel in said processing module.

22. An apparatus for processing photosensitive materials, said apparatus comprising:

a processing module comprising a container having at least one processing assembly placed in said container and at least one transport assembly disposed adjacent said at least one processing assembly, said at least one processing assembly and said at least one transport assembly forming a substantially continuous processing channel through which a processing solution flows, said processing channel comprising at least 40% of the total volume of processing solution available for the processing module and having a thickness equal to or less than about 100 times the thickness of the photosensitive material to be processed in said processing channel;

wherein at least one transport assembly is provided with at least one discharge opening for introducing processing solution through said channel; and means for circulating the processing solution through a processing channel in said module.

23. An apparatus for processing photosensitive materials, said apparatus comprising:

a processing module comprising a container having at least one processing assembly placed in said container, said at least one processing assembly forming a substantially continuous channel through which a processing solution flows, said channel having an entrance and an exit, said at least one processing assembly having a discharge opening for delivering processing solution to said channel, said processing channel comprising at least 40% of the total volume of processing solution available for the processing module and having a thickness equal to or less than about 100 times the thickness of the photosensitive material to be processed in said processing channel;

passages are provided in said module for removing processing solution from said processing channel; and means for circulating the processing solution directly from said passages provided in said processing module to said discharge opening.

* * * * *